United States Patent [19]

Akkerman

[11] 4,393,929

[45] Jul. 19, 1983

[54] WELL PACKERS AND SLIP ASSEMBLIES FOR USE THEREWITH

[75] Inventor: Neil H. Akkerman, Kingwood, Tex.

[73] Assignee: AVA International, Houston, Tex.

[21] Appl. No.: 233,627

[22] Filed: Feb. 17, 1981

[51] Int. Cl.[3] ..... E21B 33/128; E21B 33/129

[52] U.S. Cl. ..... 166/134; 166/120

[58] Field of Search ..... 166/122, 134, 120

[56] References Cited

U.S. PATENT DOCUMENTS

| | | | |
|---|---|---|---|
| 3,112,796 | 12/1963 | Myers | 166/120 |
| 3,189,095 | 6/1965 | Rochemont | 166/120 |
| 3,361,209 | 1/1968 | Edwards, Jr. | 166/134 X |
| 3,456,723 | 7/1969 | Current et al. | 166/134 X |
| 3,659,647 | 5/1972 | Brown | 166/134 X |
| 4,018,274 | 4/1977 | Cochran | 166/129 |
| 4,078,606 | 3/1978 | Montgomery | 166/120 |
| 4,216,827 | 8/1980 | Crowe | 166/120 |

*Primary Examiner*—Stephen J. Novosad

*Attorney, Agent, or Firm*—Vaden, Eickenroht, Thompson, Bednar & Jamison

[57] ABSTRACT

There is disclosed an hydraulically set well packer wherein sleeves carried about a tubular member which is connected as part of a tubing string are adapted to be moved from axially extended to axially retracted position in order to expand packing and slip elements carried about one of the sleeves into engagement with the well bore in which the string is disposed. The packer also includes means which forms an atmospheric chamber including a piston on one of the sleeves, and a means for locking the sleeves in retracted position is disposed within such chamber. The slip assembly carried by the packer includes upper and lower bowls and upper and lower sets of interconnected slips which are carried by the bowls for sliding thereover between radially contracted and expanded positions in response to movement of the slip bowls toward and away from one another as the sleeves move between extended and retracted positions.

13 Claims, 10 Drawing Figures

33
11
18
19
P
12
16
17
15
10
20A
65
64
70
71
21A
60
62
61
S
21B
20B
13
39
31
35
34A
14
34B
14A
37
38
30
32
28
41
40
26
27
29
22
25B
25
24
25A
36
52
22A
50
51
56
55
53
54

WELL PACKERS AND SLIP ASSEMBLIES FOR USE THEREWITH

This invention relates in general to packers for use in closing off the annular space between a pipe string and a well bore in which the pipe string is suspended, and to slip assemblies which are carried by the packers for radial expansion and contraction into and out of engagement with the well bore in order to anchor the packers within the bore. More particularly, in one of its aspects, it relates to improvements in packers of this type in which a tubular member adapted to be connected as part of the pipe string is surrounded by first and second sleeves, and packing and slip elements are carried about the first sleeve for expansion from normally retracted positions into engagement with the well bore in response to movement of one of the sleeves from axially extended to axially retracted position with respect to the other sleeve, such sleeve movement being effected in some cases hydraulically and in others mechanically, as by manipulation of the mandrel. In another of its aspects, this invention relates to improvements in slip assemblies suitable for use with well packers and the like wherein upper and lower sets of slips are carried about upper and lower slips, respectively, so that upon movement of the bowls axially toward or away from one another, as during setting or retrieval of the packer, both sets are urged outwardly to grip the well bore, one set usually having teeth arranged to hold the packer down and the other to hold it up, and a means being provided to interconnect adjacent ends of slips from the upper and lower slips to cause them to move axially with one another, while permitting some relative radial movement between them.

In typical hydraulically set packers of the above-described type, such as those shown in U.S. Pat. Nos. 3,112,796 and 3,189,095, a chamber which includes a piston on at least one of the sleeves contains fluid at atmospheric or other pressure less than that of ambient well fluid so that well fluid is effective to urge the sleeves toward retracted position. As the packer is lowered in the well bore, suitable means are provided for locking the sleeves in expanded position, whereby the packing element and slip assemblies will remain contracted, and, when the packer is lowered to the desired level, the locking means is released to permit the sleeves to retract and thereby set the packer. The sleeves may be moved to retracted positions by means of pressure in the pipe string which is applied to the side of the sleeve piston opposite to the atmospheric chamber.

In some cases, such as when the pressure of the well fluid drops off considerably, or the atmospheric chamber leaks, it may be desirable to lock the sleeves in retracted position in order to maintain the packing and slip elements in tight engagement with the well bore. Thus, as in the Baker "FH" packer, shown and desrcibed on pages 706–707 in the 1980–81 Edition of the *Composite Catalog of Oil Field Equipment and Services,* one sleeve is held against downward movement by a so-called thrust ring on the tubular member while ratchet teeth on a lock ring carried by the other sleeve move downwardly into engagement with ratchet teeth on the tubular member to prevent upward movement of the other sleeve and thus lock the sleeves in retracted position. The packer thus remains set until the tubular member is lifted to shear the connection of the thrust ring to the tubular member and vent the atmospheric chamber, whereby the other sleeve including the lock ring may be lifted to extended position with respect to the one sleeve. The thrust ring is connected to the tubular member by means which is shearable only in response to the application to the tubular member of a pull of predetermined force, so that the packer will not be accidentally released in response to upward forces on the tubular member of relatively minor extent.

In the packers shown and described in U.S. Pat. Nos. 4,078,606 and 4,018,174, the sleeves are retracted to expand the packing and slip elements by manually lowering the mandrel to lower one sleeve as the other sleeve is held in a fixed vertical position, as by means of drag shoes, and the sleeves are locked in retracted position by ratchet teeth on the other sleeve which move over ratchet teeth on a lock ring carried by the other sleeve. Thus, in order to retrieve the packer in response to lifting of the tubular member, it's necessary to release the ratchet teeth on the one sleeve from those on the lock ring. For this latter purpose, the ratchet teeth on the one sleeve are formed on the ends of collet fingers on the lower end of the one sleeve, and another ring is disposable between the ends of the fingers and the tubular member for holding the ratchet teeth engaged. As the tubular member is lifted, it moves the holding ring from holding position within the ends of the collet fingers to free their lower ends to expand inwardly to release the ratchet teeth. Continued lifting of the tubular member lifts the holding ring into engagement with a shoulder on the one sleeve so that it may then be lifted with the tubular member to retracted position with respect to the other sleeve.

In the case of the above-mentioned packers, the lock ring and associated parts for locking the sleeves in retracted position are exposed to the corrosive environment of the well fluid as well as to accidental displacement, and it is an object of this invention to provide a packer of this general type in which the lock ring and its parts are protected against these possibilities.

In the case of the hydrostatically set Baker Type "FH" packer, well conditions may be such that the holddown slips, in the form of pressure responsive buttons, will not maintain tight engagement with the well bore. As a result, the sleeve on which such slips are carried may be raised by the compressed force in the packing element, which, due to the locking engagement of the sleeve with the tubular member, will lift the thrust ring against the other sleeve with such force as to place undue strain upon it. These well conditions may occur, for example, if well fluid pressure above and below the packer is equalized, and would be accentuated if the atmospheric chamber would leak and thus impose further upward force on the one sleeve.

It is therefore another object to provide a similarly hydrostatically set packer in which no such strain would be placed on the thrust ring under such well conditions.

Also, the tubular member of the Baker Type "FH" packer is specially prepared to catch and retrieve the thrust ring, when sheared therefrom, so that the ring does not form junk in the well bore. Also, the ring is releasably connected to the tubular member by a shearable element which must be replaced in the event it is desired to release the ring in response to a different force, which requires a large inventory of different shearable elements. In addition, the shearable connection of the thrust ring to the tubular member does not afford the option of alternatively releasing the ring in response to torque applied to the tubular member.

It is therefore a further object of this invention to provide a similar type of packer in which the thrust ring may be caught and retrieved without specially preparing the tubular member therefor, and/or in which the ring may be released by application of either tension or torque to the tubular member.

In conventional slip assemblies of the type above described, the slip bowls have flat expander surfaces over which corresponding shaped surfaces of the slips are slidable. As a result, the bowl must be relatively thick in order to maintain sufficient metal back up for the slips. This in turn reduces the bore through the packer or other well tool on which the slip assembly is mounted, and thus requires the drilling of a larger diameter well bore.

In other types of slip assemblies, wherein the slips are double ended—i.e., provided with oppositely facing gripping teeth at their opposite ends—or where the slips are arranged in single, unconnected sets, the expander surfaces on the bowl and slips are convex-concave, which permits the bowl to be thinner without sacrificing its strength. However, as far as I am aware, these expander surfaces are conically shaped, and, as a result, they theoretically do not maintain surface-to-surface contact as the slips slide along the bowls. Instead, the conical shape of the slip expander surface will match that of the bowl expander surface at only one vertical level of the slip relative to the bowl, and at other levels, the slips will theoretically have only line-to-line contact with the expander surface of the bowl.

Since the connection of the upper and lower slips permits relative radial movement between them, one may move out to grip the well bore prior to the other, as, for example, when there is foreign matter between the expander surfaces of one slip and its bowl which increases frictional resistance to sliding. This may prevent the assembly from being fully set, if, for example, slips from both the upper and lower sets are prematurely set so that the bowls are prevented from full movement toward one another. In the case of a packer of the type described, the packing element may not be fully set if the upper slips are set before the lower slips, and the upper packer compressing sleeve is therefore limited in its downward stroke. Although it has been proposed to delay full radial movement of one set of slips in an attempt to insure that all of the slips of the other set first move into full gripping engagement with the well bore, the means for doing so is unduly complex and expensive. Thus, a groove is formed in the upper bowl above the slips to receive a ring which is held by shear pins in a position to engage and initially limit sliding of such slips.

The connection between the slips of the upper and lower slips normally comprises a ring disposed between their adjacent end edges, the end edges of the slips and ring being provided with matching "T"'s and "T"-slots which guide the slips for radial movement with respect to the ring and thus one another. This additional machine part will of course add to the expense of the overall assembly, and although it has also been proposed to interconnect axially aligned parts of upper and lower slips directly to one another by means of a "T"0 on one fitting within a "T"-slot on the other, this requires that two different parts be manufactured and inventoried.

It is yet another object of this invention to provide a slip assembly having interconnected upper and lower sets of slips, as above described, but in which the bowls and slips are so constructed as to minimize the thickness of the assembly without loss of metal back up for the slips.

Yet a further object is to provide a bowl and slips suitable for use with an interconnected assembly of the type described, or other assembly, wherein the expander surfaces are convex-concave, but of such shape as to maintain surface-to-surface contact therebetween during sliding of the slips; and, more particularly, of such shape as to simplify machining of the surfaces as well as slots in the bowl at each side of the expander surfaces to receive dovetails to retain the slips on the bowls.

Still another object is to provide a slip assembly of the type described having a simple and inexpensive means for delaying movement of the slips of one set toward gripping engagement with the well bore.

A still further object is to provide a slip assembly of the type described wherein the slips of the two sets are directly interconnected to one another in such a manner that all of them may be of identical construction.

These and other objects are accomplished, in accordance with the illustrated embodiment of the invention, by a packer of the type described in which a circumferentially expandible and retractible lock ring and corresponding parts for locking the sleeves in retracted position are disposed within an atmospheric chamber, and thus in a position in which they are protected from corrosive elements of the well fluid as well as from accidental damage during running of the tool. More particularly, the corresponding locking parts are on the sleeve so as to lock said sleeves directly to one another in their axially retracted position, and a means is provided for releasing them from locking engagement in response to lifting the tubular member. Thus, in a packer similar to the Baker "FH" packer, wherein a thrust ring is releasably connected to the tubular member in position to engage a shoulder on one of the sleeves, and thereby limit the lifting of the tubular member until predetermined upward force is applied thereto, undue strain is not imposed on the thrust ring in the event of well conditions similar to those described. In the illustrated and preferred embodiment of the invention, the sleeve whose piston is responsive to pressure within the atmospheric chamber has radially expandible and retractible collet fingers on which the locking parts are formed, and another ring is disposable between the collet fingers and the tubular member in order to hold the ratchet teeth and sleeves engaged, means being provided on the tubular member for lifting the holding ring from holding position in response to lifting of the tubular member.

In accordance with further novel aspects of the present invention, the thrust ring is caught and retrieved, upon release from the tubular member, by means on the sleeve whose shoulder is engaged by the thrust ring. Thus, it's unnecessary to specially prepare the tubular member to catch and retrieve the released thrust ring. In its preferred form, the means for catching and retrieving the thrust ring merely comprises a pin on the sleeve fitting within a slot in the thrust ring which has a closed upper end. Preferably, the thrust ring is a nut which is threadedly connected to the tubular member, the threads being straight in order to permit adjustment of the force at which the nut is caused to shear. More particularly, the pin on the sleeve which fits within a slot in the nut will hold the nut against rotation, whereby the tubular member may be rotated to release the nut, thereby providing the operator with the alternative of releasing the nut either by an upward strain on the pipe string or by the application of torque thereto.

Other objects of this invention are accomplished by means of a slip assembly of the type described wherein the expander surfaces on the slip bowls are generally convex and those on the slips are generally concave, with the expander surfaces on the bowls tapering inwardly towards intersection with the adjacent ends of the pair of bowls, and a means being provided for interconnecting each slip of one bowl with at least one slip of the other bowl for the purposes previously described. As a result, a slip assembly of this type is provided which is of minimum thickness in a radial direction, but of substantial strength insofar as metal back up of the slips is concerned, such that the slip assembly provides the desired bore therethrough in a well bore of minimum diameter. More particularly, in the preferred and illustrated embodiment of the slip assembly, dovetail slots are formed in the bowls along opposite sides of the expander surfaces, and the slips have dovetails along their opposite sides which are guidably slidable in the slots.

More particularly, the expander surfaces on the slips and its bowl are of a matching shape such that they will maintain surface-to-surface contact with one another as the slips slide along the bowls. In a preferred and illustrated embodiment of the invention, this surface is made up of planar surfaces which extend at a unform angle with respect to one another thorughout their length. Alternatively, the expander surfaces may be cylindrical in shape and thus provide the same function in that the surface is of the same cross-sectional shape from one end to the other. It is preferred, however, that the expander surfaces be formed by angularly disposed planar surfaces since this simplifies machining of the expander surfaces. Furthermore, when the bowls and slips are provided with interfitting dovetails and dovetail slots, it enables the bottom surface of the slots on opposite sides of the expander surfaces to be formed by the same machining operation and thus coplanar with the planar surfaces of the expander surface.

In accordance with another novel aspect of the present invention, the set of slips on one bowl are initially held against sliding along the expander surfaces toward gripping positions by means of shear pins on the expander surfaces of the bowl. Thus, as compared with the complicated arrangement previously described, it is merely necessary to drill holes in the expander surface to receive standard shear pins in such positions that they are adjacent the thin ends of the slips of the one set. In the case of a packer of the type described, the pins would be mounted on the upper bowl so as to delay setting of the upper slips.

In one illustrated embodiment of the invention, the expander surfaces of the bowls and thus the slips mounted on the expander surfaces are arranged in axially aligned pairs, with the pairs of slips being directly connected together by matching "T"'s and "T"-slots. In another embodiment of the invention, however, a still further object is accomplished by an assembly in which the expander surfaces of each bowl and thus the slips mounted thereon are laterally offset with respect to those of the other bowl, and means are provided on each slip of one set for directly interconnecting it to a pair of laterally offset slips of the other set so that all of the slips move axially together during setting of the slip assembly. More particularly, all of the slips, both those of the upper and lower sets, are identical, with the interconnection between them comprising a "T" on each slip whose lateral projections fit closely within lateral recesses of adjacent slips on opposite sides of the stem of the "T".

In the drawings, wherein like reference characters are used throughout to designate like parts:

Figures 1A, 1B:
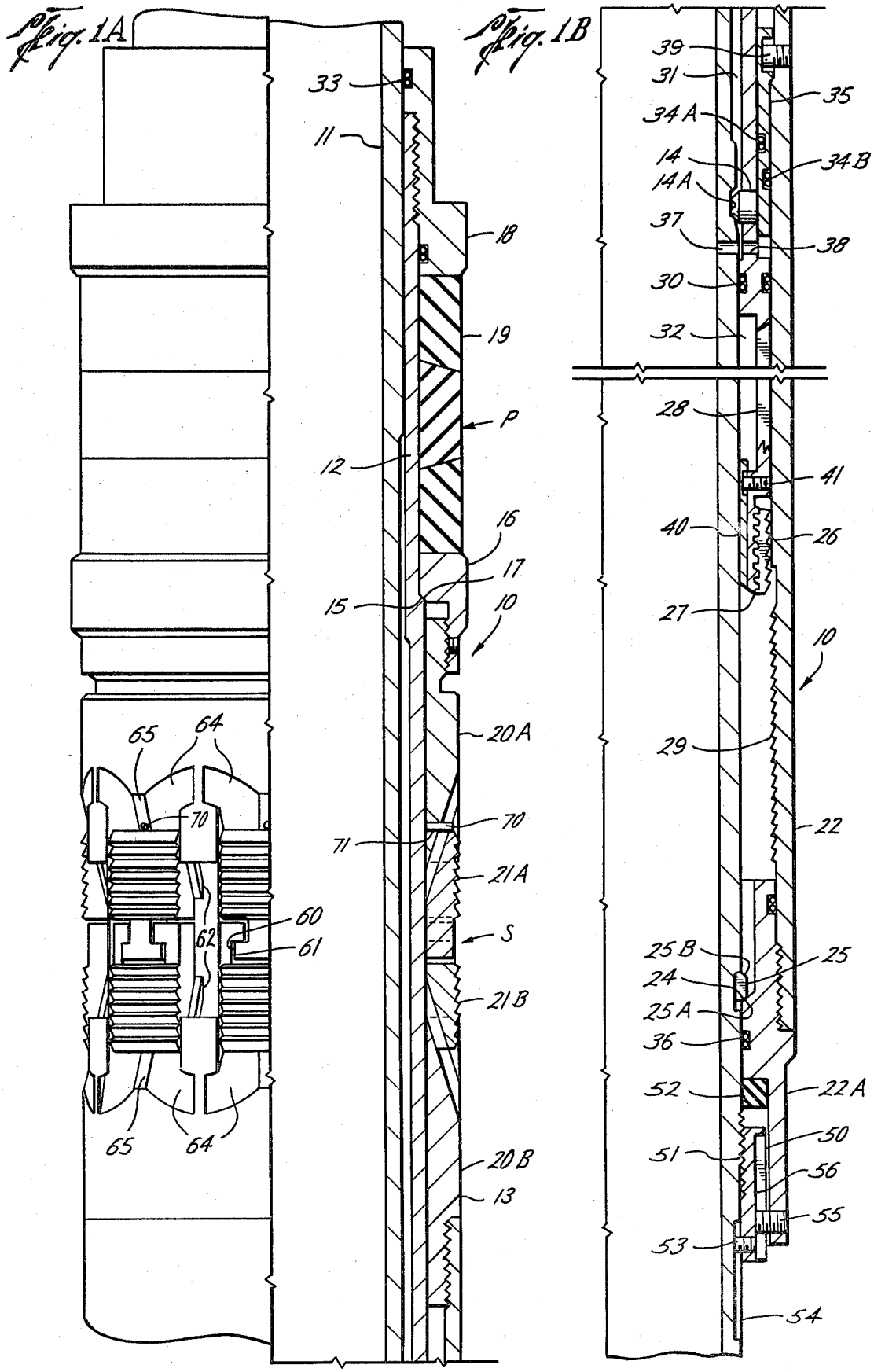
FIGS. 1A and 1B are views of the upper and lower ends of a hydraulically set packer constructed in accordance with the present invention, FIG . 1A showing the packer partly in elevation and partly in vertical cross section and FIG. 1B showing the right side thereof in elevation, and the sleeves thereof being shown in axially extended positions and the packing and slip elements contracted.

With reference now to the details of the above-described drawings, the overall packer, which is indicated in its entirety by reference character 10, comprises a tubular member 11 which is adapted to be connected as part of a well tubing (not shown) or other pipe string, a first sleeve 12 which surrounds the tubular member for axial movement with respect to it, and a second sleeve 13 which surrounds the tubular member and the first sleeve for axial movement with respect to them. A packing element P and a slip element S are carried about the first sleeve 12 between oppositely facing shoulders on the sleeves so as to be expanded from normally contracted positions (FIG. 1A), in which the packer may be lowered within a well bore WB of a casing to expanded positions (FIG. 2A) in tight engagement with the bore in response to movement of the first and second sleeves from axially extended to axially retracted positions with respect to one another.

When the sleeves are in extended positions, sleeve 13 is supported from sleeve 12 by a shoulder 15 about a nut 16 on the upper end of the sleeve 13 which seats on a shoulder 17 about the sleeve 12. Sleeve 12 is in turn releasably locked to tubular member 11 by means of a pin 14 carried by the sleeve for fitting within a groove 14A about the tubular member. Hence, both sleeves as well as the packing and slip elements are carried by the tubular member as the packer is lowered into the well bore.

A nut 18 on the upper end of the sleeve 12 has a lower end which is so spaced from the upper end of nut 16 that, with the sleeves extended, packing element P is permitted to assume its normally retracted position out of engagement with the well bore WB. Sleeve 13 includes upper and lower slip bowls 20A and 20B which support upper and lower sets of circumferentially spaced slips 21A and 21B, respectively, and, in the embodiment shown in FIGS. 1 to 7, the adjacent ends of axially aligned pairs of slips of the two sets are interconnected, in a manner and for a purpose to be described to follow. The upper bowl is connected to the lower end of nut 16, and a tubular extension connects the lower bowl to a nut 22 at the lower end of the sleeve 13 which fits closely about the tubular member 11 beneath the lower end of the sleeve 12. A shoulder 24 on the nut engages a downwardly facing shoulder 25A on a ring 25 carried about the tubular member, so that with the slips connected to the bowls by dovetails and dovetail slots, as well known in the art and to be described to follow, the nut 16 at the upper end of the sleeve 12 may be manipulated to adjust the effective length of the sleeve 13 and thus stretch it in order to withdraw the slips to their contracted positions.

As will be described in more detail to follow, when the packer is to be set, the pin 14 carried by the first sleeve is released from locking engagement with groove 14A in the tubular member so as to free the first sleeve for lowering with respect to the second sleeve. As the first sleeve is so moved toward retracted position, the slip bowls 20A and 20B will move relatively toward one another so as to move the upper and lower sets of slips outwardly into engagement with the well bore WB, and the relative downward movement of the lower end of nut 18 with respect to the upper end of nut 16 will expand packing element P into sealing engagement with the well bore above the slip assembly.

At the same time, ratchet teeth 26 on a lock ring 27 on the outer circumference of the lower end of the collet fingers 28 on the lower end of the first sleeve will move downwardly within an annular space between the tubular member and second sleeve so as to ratchet over ratchet teeth 29 formed on the inner diameter of the second sleeve, and thereby lock the first sleeve against return movement to extended position with respect to the second sleeve. In this manner, the packing and slip elements are locked in expanded positions, and the packer thus held in its set position, until the locking means between the first and second sleeves is released in the manner to be described hereinafter.

Figure 3:
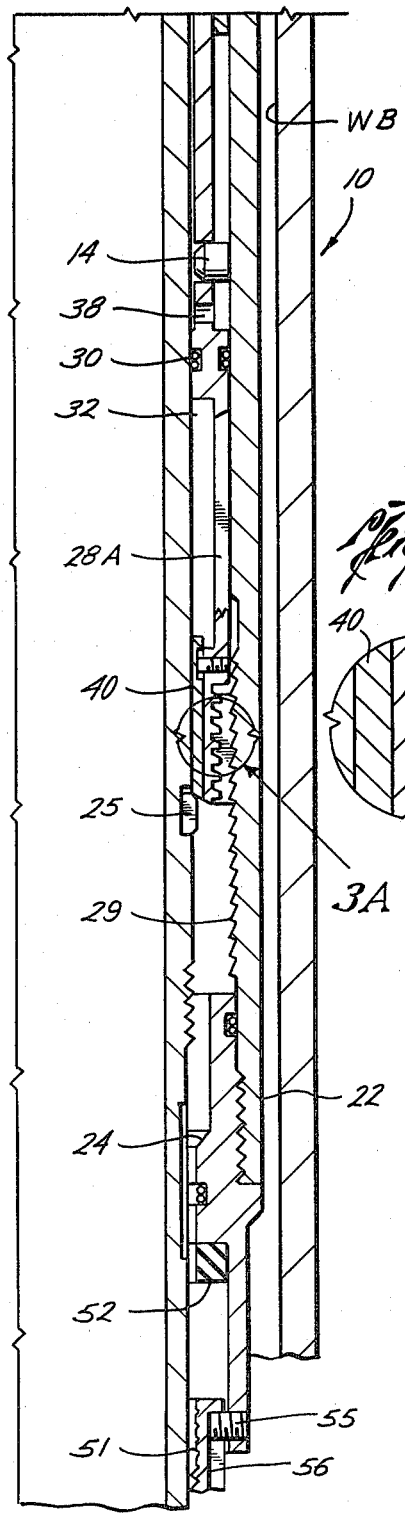
FIG. 3 is a vertical sectional view of the lower end of the right hand side of the packer, similar to FIG. 2B, but upon lifting of the tubular member to shear the connection of the thrust ring thereto and open the atmospheric chamber to fluid in the well bore.
Figure 3A:
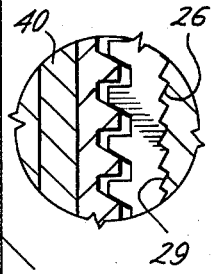
FIG. 3A is an enlarged sectional view of the inset portion 3A of FIG. 3.

The lock ring 27 is split about its circumference and, in its normally unstressed position, is circumferentially expandible and contractible. As best shown in the enlarged detail adjacent FIG. 3A, ring 27 has buttress threads about its inner circumference which provide downwardly tapered wedge surfaces supported upon corresponding surfaces of buttress threads on the outer circumference of the lower end of collet fingers 28. As also best shown in the detailed view adjacent FIG. 3A, lock ring 27 is normally circumferentially expanded to move its ratchet teeth 26 into full engagement with the ratchet teeth 29 of the second sleeve. However, the wedging surfaces on the lock ring and the collet fingers of the first sleeve are so constructed and arranged that the lock ring may circumferentially contract so as to permits its ratchet teeth to move downwardly over the ratchet teeth on the second sleeve. At the same time, the wedging surfaces between the lock ring and the collet fingers will not permit the ratchet teeth of the lock ring to move upwardly past those of the second sleeve, and thus will prevent return movement of the first and second sleeves to extended positions with respect to one another, at least until such time that the locking engagement between the lock ring and the second sleeve is released.

Figure 4:
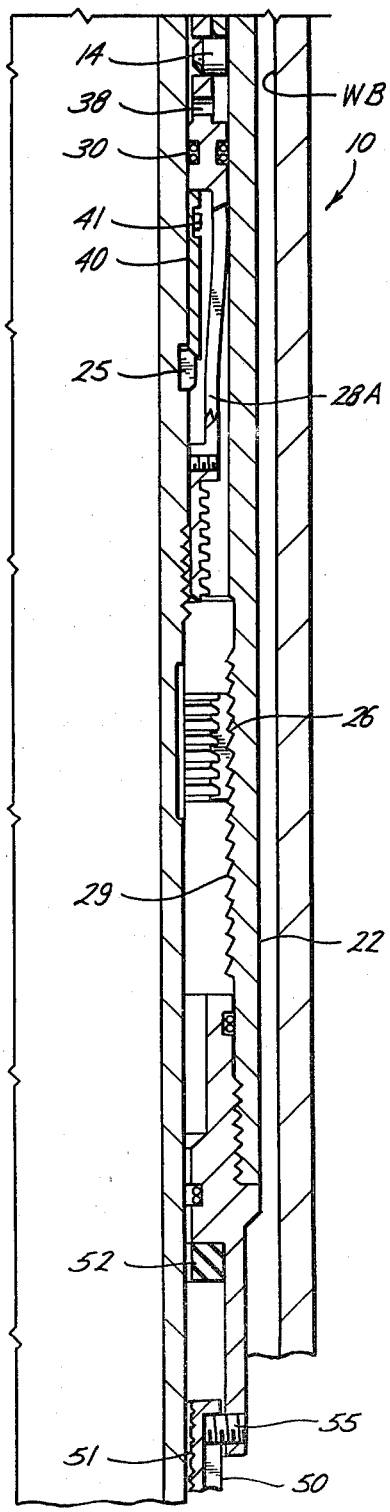
FIG. 4 is another vertical sectional view of the lower end of the packer, similar to FIG. 3, but upon further lifting of the tubular member to remove the holding ring from within the collet fingers of one sleeve to release the locking engagement of its collet fingers with the lock ring.

Another ring 40 is releasably attached to the collet fingers by means of shear screws 41 so as to be disposed between the inner circumference of the collet fingers and the outer circumference of the tubular member generally opposite the ratchet teeth and wedging surfaces. More particularly, ring 40 fits closely between the collet fingers and the tubular member so as to hold the wedging surfaces of the lock ring in locking position with respect to the second sleeve. In a manner to be described, when the packer is to be retrieved, the holding ring 40 is raised from its holding position into a position within a recess 28A about the inner circumference of the collet fingers, as shown in FIG. 4, whereby the collet fingers are free to move radially inwardly in response to lifting of the first sleeve, which permits their wedging surfaces to be moved upwardly past the wedging surfaces on the inner circumference of the lock ring, so as to release the locking engagement between the first and second sleeves, as shown in FIG. 4.

Holding ring 40 is lifted from its holding position within the lower ends of the collet fingers by means of a shoulder 25B on the upper end of ring 25 carried by the tubular member. Thus, as the tubular member is lifted with respect to the sleeves, as will be described to follow, ring 25 will engage the lower end of holding ring 40 so as to shear screws 41 and lift the holding ring into the above-mentioned recess. Further lifting of the tubular member will lift the upper end of the released holding ring 40 into engagement with a downwardly facing shoulder on the first sleeve 12, so that upon continued lifting of the tubular member, the first sleeve will be lifted with respect to the second sleeve so as to move them into extended positions in which the packing and slip elements are contracted and the packer may be retrieved by continued lifting of the tubular member.

First sleeve 12 has a piston 30 thereon above the collet fingers which is sealably engaged with each of the tubular member and the second sleeve 13, and the nut 22 at the lower end of the second sleeve 13 has a seal ring 36 carried about its inner circumference for sealing with respect to the tubular member. Thus, the annular space between the tubular member and second sleeve beneath piston is sealed off to not only protect the sleeve locking parts from corrosive well fluids outside of the chamber, but also protect them from physical damage by engagement with other parts during manipulation of the packer. The sealed off space also provides a chamber in which fluid at atmospheric pressure or some other pressure less than that of the ambient well fluid may be contained. As a result, when the first sleeve is released from locking engagement with the tubular member, as will be described to follow, well pressure is effective over the pressure responsive surfaces of the first and second sleeves to urge them toward retracted position. The second sleeve 13 is held against upward movement by the ring 25 on the tubular member as well pressure urges the first sleeve 12 downwardly with respect to the second sleeve.

The pin 14 is caused to move out of slot 14A so as to release the first sleeve in response to fluid pressure in the tubing. Thus, the bore of the tubing is adapted to be closed by a plug or the like, shown diagrammatically at P' in FIG. 2B, and a port 37 in the tubular member connects with annular spaces between the first sleeve and the tubular member and the first and second sleeves just above piston 30. More particularly, a seal ring 33 carried by the nut 18 of the first sleeve seals about the tubular member at the upper end of the space, and an annular sleeve 35 which is vertically reciprocable within the outer annular space beneath the first and second sleeves carries seal rings 34A and 34B about tis inner and outer circumference to seal between the sleeves.

Figure 2A:
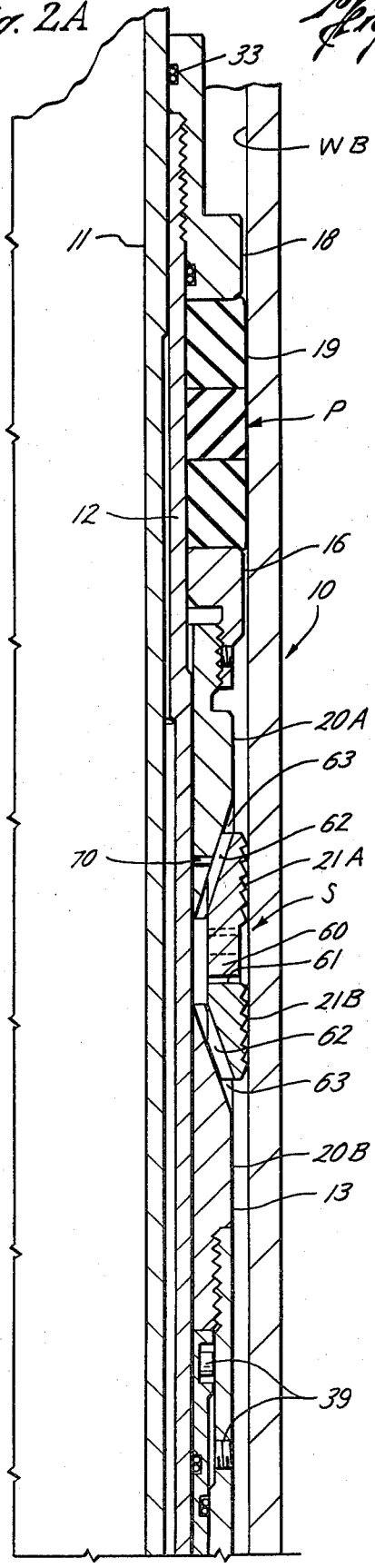
FIGS. 2A and 2B are vertical sectional views of one side of the upper and lower ends of the packer of FIGS. 1A and 1B, upon lowering into a well bore and with the sleeves thereof moved to and locked in axially retracted positions so as to expand the packing and slip elements into engagement with the well bore.
Figure 2B:
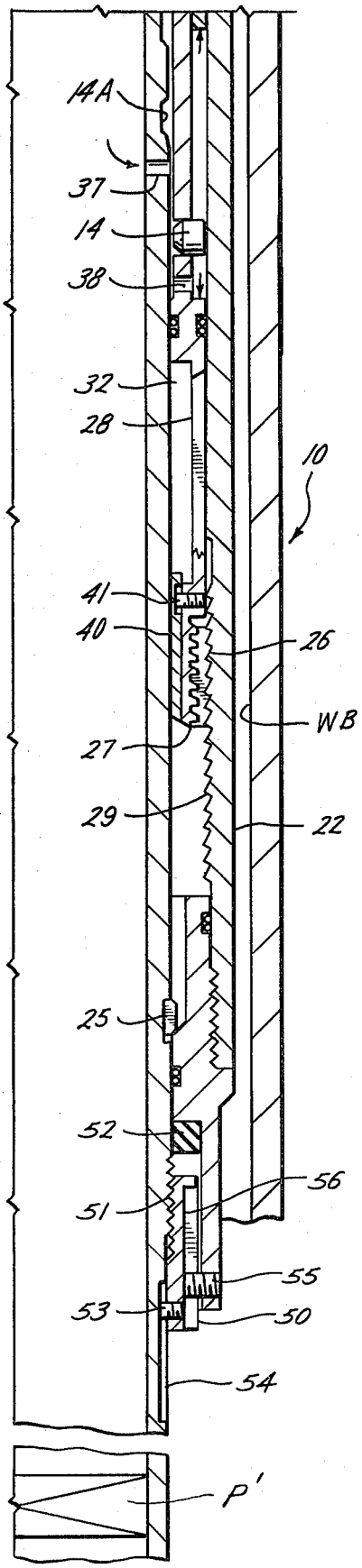

As shown in FIG. 1B, sleeve 35 is normally held in a lower position by means of a shear screw 39 carried by the second sleeve, and, in this lower position, is disposed about the outer end of the pin 14 so as to hold it within the groove 14A. However, the port 38 is formed in the first sleeve above piston 30 so that the tubing pressure can pass into the lower end of the chamber beneath the sleeve 35 to urge it in an upward direction. This upward force on the sleeve will shear the screw 39 and thus move the sleeve upwardly to the position of FIG. 2A in which it is removed from the outer end of the pin 14. The lower edge of groove 14A is tapered downwardly so that, with sleeve 35 removed the pin 14 is forced outwardly to its unlocked position, as shown in FIG. 2B, in response to downward movement of the first sleeve. Obviously, once the first sleeve has been released from the tubular member, the plug P' may be removed to open up the bore of the tubing string, and the tubing pressure relieved, as desired.

As previously mentioned, in order to prevent the tubular member from being raised accidentally and prematurely unlocking the sleeves, a thrust nut 50 is theadedly connected at 51 to the tubular member beneath a downwardly facing shoulder 52 on the nut 22A at the lower end of the second sleeve 13. The threads of the connection 51 are straight so that the amount of shear required to release the connection is dependent upon the number of them that are made up. If desired, the threads on the nut 50 could be of such construction that one or more of them would shear in response to a different upward force applied to the tubular member. When made up with the tubular member to the desired extent, the nut is held against further rotation by a screw 53 adapted to be advanced into a vertical slot 54 in the side of the tubular member. Screw 53 is adapted to be sheared as the lower end of slot 54 is lifted against it, following shearing of threads 51 on the nut, to permmit the tubular member to continue to be lifted.

As also previously described, a means is provided for alternatively releasing the thrust nut from the tubular member in response to rotation of the mandrel, and, for this purpose, a screw 55 carried on the lower end of the nut 22A fits within a vertical slot 56 in the outer diameter of the nut so as to hold the nut against rotation with the tubular member. As shown, the upper end of the slot 56 is closed so that, upon release of the nut from the mandrel, either in response to shearing of the threaded connection 51 therebetween, or in response to the application of torque to the tubular member, the inner end of the pin 55 on the second sleeve will catch the nut and retrieve it from the well bore along with the packer.

Upon release of the nut from the tubular member, the ring 25 carried by the tubular member is raised therewith to lift the lower end of ring 40 from within the lower ends of the collet fingers and into the recess beneath piston 30, so that, as previously described, collet fingers may contract to release the connection of the first sleeve to the second sleeve. As will be understood from a comparison of FIGS. 2B and 3, upon lifting of the tubular member, the smooth outer diameter of the tubular member is withdrawn from seal means 36 to open the lower end of chamber 32 to well fluid in the well bore. Consequently, second sleeve 13 is no longer held up by well fluid so that, as the collet fingers are released from the lock ring, as shown in FIG. 4, the second sleeve is free to drop into its supported position on the first sleeve, thereby returning the sleeves to extended position to permit the packing and slip elements to contract. Thus, the packer may be retrieved by further lifting of the tubular member to raise ring 40 into engagement with the lower end of piston 30 and thus support the first sleeve from the mandrel. Shoulder 52 on the lower end of the sleeve is formed on a pad of rubber or other suitable cushioning material so as to even out the upward impact of nut 50 which might otherwise cause its connection 51 to the tubular member to bind in the process of retrieving the packer.

Figure 5:
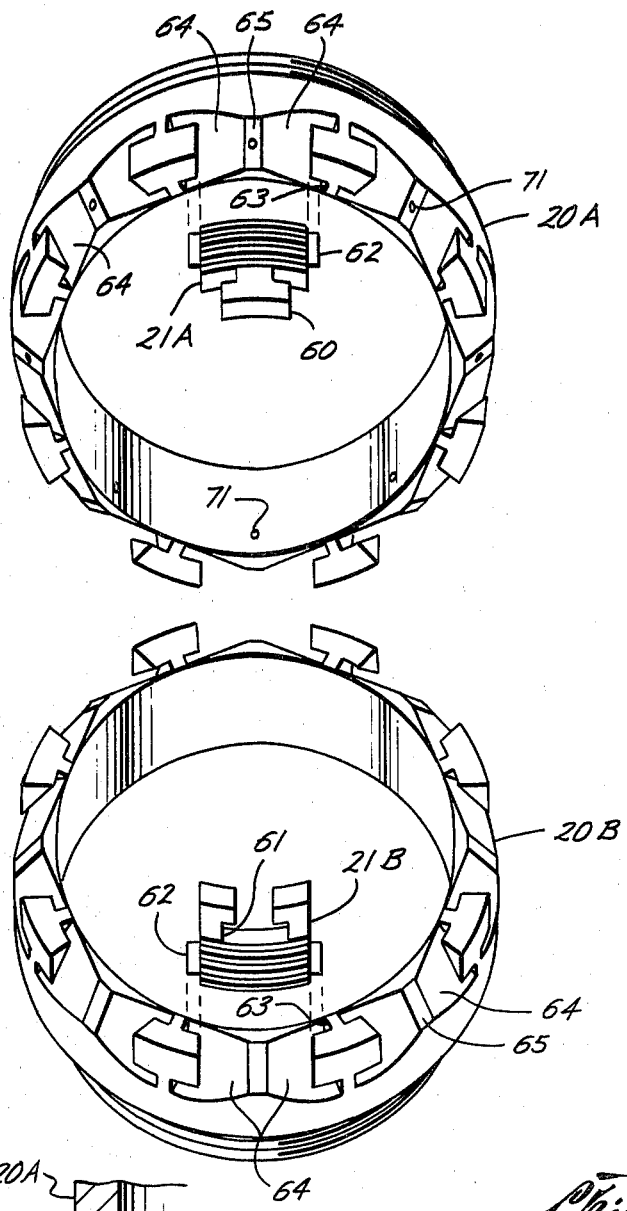
FIG. 5 is an exploded view of upper and lower slip bowls of one embodiment of a slip assembly constructed in accordance with this invention, with a pair of slips adapted to be supported on axially aligned pairs of expander surfaces on the bowls being shown removed therefrom.
Figure 6:
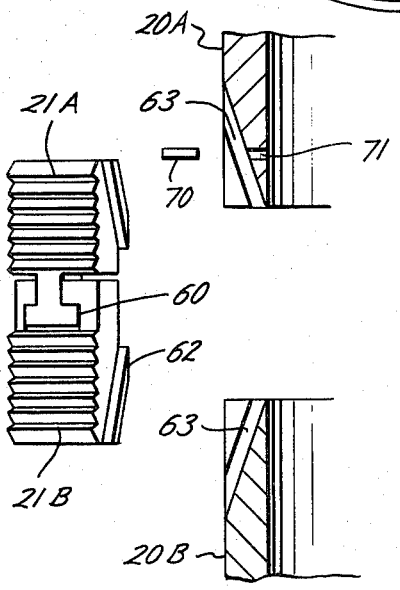
FIG. 6 is an exploded view of a pair of interconnected slips and the expander surfaces on the slip bowl from which they have been removed.
Figure 7:
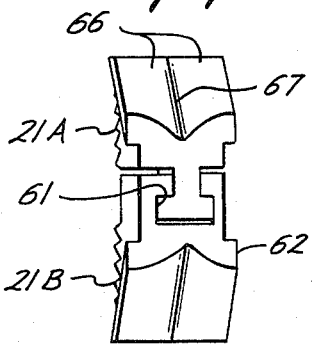
FIG. 7 is a perspective view of the interconnected slips shown in FIG. 6, as seen from the inner side thereof.

As best shown in FIG. 5, upper and lower slip bowls 20A and 20B have expander surfaces which converge radially outwardly toward intersection with their inner ends, and upper and lower sets of slips 21A and 21B, respectively, are supported on the bowls for sliding thereover between contracted and expanded positions as the bowls are moved axially toward and away from one another. More particularly, in the embodiment shown in FIGS. 1 to 7, the expander surfaces are arranged in axially aligned pairs spaced circumferentially about the bowls 20A and 20B, respectively, and, as will be described to follow, to support axially aligned pairs of slips which are interconnected so as to prevent them from moving axially toward or away from one another, while permitting them to move relatively to one another in a radial direction.

The slips are held in sliding engagement with the expander surfaces by means of dovetails 62 along their opposite sides which fit within dovetail slots 63 on the opposite sides of the bowl expander surfaces. Aa shown, the sides of each slip as well as the side edges of the dovetails and dovetail slots are parallel to one another so as to confine the slips for movement in radial directions as they slide along the expander surfaces.

The aligned pairs of slips are connected to one another by means of a "T"-slot 61 on the end of lower slip 21A for guidably receiving a "T" 60 on the adjacent end of upper slip 21B. More particularly, the surfaces forming the "T" and "T"-slot extend radially so as to permit the slips of each pair to move with respect to one another in a radial direction, while restraining them for axial movement with one another, whereby the dovetail connections will not bind even though the slips do not slide in unison.

As previously described, each expander surface is formed by a pair of planar surfaces 64 which converge in a radially outward direction to form an angle between them of only slightly less than 180°. As shown, the adjacent edges of the planar surfaces 64 intersect along an axially extending land 65. Also, the inner sides of the dovetail slots 63 are preferably continuations of the planar surfaces 64 so that they may be machined in the same operation.

The inner faces of the slips which slide over the expander surfaces are similarly formed of a pair of planar surfaces 66 which form an angle therebetween essentially the same as the angle formed between the bowl expander surfaces 64. As shown, these planar surfaces intersect to provide a valley 67 which moves over the land 65 as the slips slide along the expander surfaces, and the outer surfaces of the dovetails on the sides of the slips are continuations of the planar faces 66 of the slips.

As previously described, a shear pin 70 fits within a hole 71 through each expander surface on the upper bowl 20A so as to initially limit upward movement of the slip along such surface. More particularly, the holes are preferably formed in the lands 65 and so located along the length of the land that the upper thin edge of each upper slip 21A is adjacent to the bottom edge of the pin 70 received in the hole. The pins are of such strength as to permit the slips 21B mounted on the lower bowl 20B to move into gripping engagement with the well bore before such pins are sheared. As previously described, with the slip assembly carried on a packer of the type shown and described, mounting of the pins on the expander surfaces of the upper bowl insure that the lower slips are set before the upper slips. If the slips setting sequence were reversed, the packing element might not be fully compressed.

Figure 8:
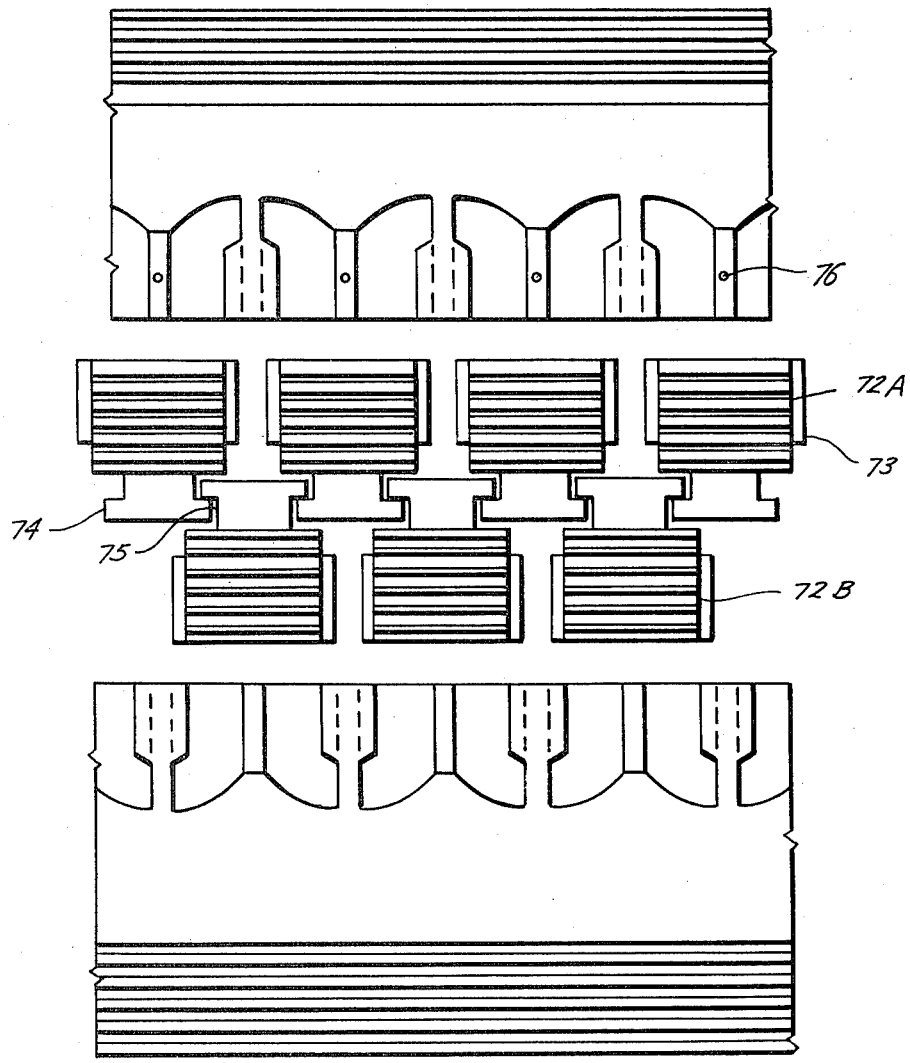
FIG. 8 is an elevational view of the outer sides of a group of interconnected slips of a slip assembly constructed in accordance with another embodiment of the invention.

As previously described, in the alternative embodiment of the slip assembly shown in FIG. 8, the expander surfaces on the upper and lower bowls are laterally staggered with respect to one another, rather than being axially aligned, as in the case of the previously described slip embodiment. Consequently, the upper and lower sets of slips, which are indicated at 72A and 72B in FIG. 2, are similarly staggered in a lateral direction with respect to one another. Although not shown, the expander surfaces on the bowls and the expander surfaces on the inner sides of the slips are formed in a manner identical to that described in connection with the embodiment of FIGS. 1 to 7, including dovetail slots in the opposite sides of the expander surfaces of the bowls to receive dovetails 73 on opposite sides of each slip.

As in the previously described embodiment, the slips of the upper set are directly connected to slips of the lower set. However, as distinguished from the previous embodiment, each slip of one set is directly connected to adjacent slips of the other set, thereby not only interconnecting the slips of the two sets to one another, but also interconnecting the slips in each set to one another, for axial movement together, while permitting relative radial movement between them. Thus, as shown in FIG. 8, the large end of each slip has a "T" 74 formed thereon whose outward projections fit within recesses 75 formed on opposite sides of the stem of the "T" within the sides of adjacent slips of the other set. More particularly, the "T"'s are of somewhat less width than the main body of the slips, and their projections fit closely within the recesses 75 so as to interconnect the slips in the manner described. Still further, and again as previously described, this means of interconnecting the slips of the upper and lower sets enables all the slips to be of identical construction, as shown, thereby greatly simplifying manufacture and inventory.

Although, in the embodiment of FIG. 8, all slips of each set are interconnected for movement with one another in an axial direction, it is also preferred that a means be provided to delay movement of the slips of one set into gripping engagement until the slips of the other set have been so moved. Thus, as in the case of the embodiment of FIGS. 1 to 7, pins 76 are mounted on the expander surfaces of the upper bowl in position to limit upward movement of the upper slips until the lower slips have been moved into gripping engagement with the well bore, such that continued contraction of the sleeves of the packer, or other means for moving the slip bowls axially toward one another, will cause the upper edges of the upper slips to bear against the pins 76 with sufficient force to shear them.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. A packer for use in closing off an annular space about a pipe string within a well bore, comprising a tubular member adapted to be connected as part of the pipe string, first and second sleeves surrounding the tubular member, normally contracted packing and slip elements carried about the first sleeve, means for expanding the packing and slip elements into engagement with the well bore in response to movement of one of said sleeves from an axially extended to an axially retracted position with respect to the other sleeve, means forming an annular chamber in which fluid at a lesser pressure than ambient well fluid may be contained and including a piston on said one sleeve, whereby said well fluid urges said one sleeve toward retracted position, and a circumferentially expandible and contractible ring disposed within said chamber and having wedging surfaces and ratchet teeth on its opposite sides engageable with corresponding parts on said one sleeve and one of the other sleeve and tubular member for locking said sleeves against extension as said one sleeve is moved to retracted position.

2. A packer of the character defined in claim 1, wherein the corresponding parts are on said other sleeve so as to lock said one sleeve directly to said other sleeve.

3. A packer for use in closing off an annular space about a pipe string suspended within a well bore, comprising a tubular member adapted to be connected as part of the pipe string, first and second sleeves surrounding the tubular member, normally contracted packing and slip elements carried about the first sleeve, means for expanding the packing and slip elements into engagement with the well bore in response to movement of said sleeves from axially extended to axially retracted positions with respect to one another, means for locking said sleeves against extension as they are moved to retracted position, means for releasing said locking means in response to lifting of said tubular member with respect to said sleeves, a thrust ring connected to the tubular member in a position to engage a shoulder on one of the sleeves in order to limit upward movement of said tubular member and then release therefrom when a predetermined upward force is applied thereto, and means on said one sleeve for catching and retrieving the ring upon release thereof.

4. A packer of the character defined in claim 3, wherein the means for catching and retrieving the ring comprises a pin on the one sleeve fitting within a slot in the ring having a closed upper end.

5. A packer of the character defined in claim 3, wherein said shoulder is formed on the lower end of a resilient pad.

6. A packer for use in closing off an annular space about a pipe string suspended within a well bore, comprising a tubular member adapted to be connected as part of the pipe string, first and second sleeves surrounding the tubular member, normally contracted packing and slip elements carried about the first sleeve, means for expanding the packing and slip elements into engagement with the well bore in response to movement of said sleeves from axially extended to axially retracted position with respect to one another, means for locking said sleeves against extension as they are moved to retracted position, means for releasing said locking means in response to lifting of said tubular member with respect to said sleeves, and a nut threadedly connected to the tubular member in position to engage a shoulder on one of said sleeves so as to limit upward movement of said tubular member and then release therefrom when a predetermined force is applied thereto to shear said threads, said threads being straight in order that the force at which they shear may be determined by the extent to which they are made up.

7. A packer of the character defined in claim 6, including a means on said one sleeve for catching and retrieving the nut upon release.

8. A packer of the character defined in claim 6, wherein the shoulder is formed on the lower end of a resilient pad.

9. A packer of the character defined in claim 6, wherein a pin on the one sleeve fits within a slot in the nut to hold said nut against rotation, whereby the tubular member may be rotated to release the nut.

10. A packer of the character defined in claim 9, wherein the upper end of the slot is closed so that the nut is caught by and lifted with the one sleeve when released from the tubular member.

11. A packer for use in closing off an annular space about a pipe string suspended within a well bore, comprising a tubular member adapted to be connected as part of the pipe string, first and second sleeves surrounding the tubular member, normally contracted packing and slip elements carried about the first sleeve, means for expanding the packing and slip elements into engagement with the well bore in response to movement of one of said sleeves from axially extended to axially retracted position with respect to the other sleeve, means forming an annular chamber in which fluid at a lesser pressure than ambient well fluid may be contained and including a piston on one of said sleeves, whereby ambient well fluid urges said one sleeve toward retracted position, a circumferentially expandible and contractible ring disposed between said one sleeve and the other sleeve and having wedging surfaces and ratchet teeth on its opposite sides engageable with corresponding parts on said sleeves for locking said sleeves against extension as they are moved to retracted position, another ring disposable between said one sleeve and the tubular member for holding the ratchet teeth and wedging surfaces engaged, means on the tubular member for lifting the holding ring from within the one ring upon lifting the tubular member with respect to the sleeves, and a thrust ring connected to the tubular member in a position to engage a shoulder on the other sleeve in order to limit lifting of the tubular member and then release therefrom when a predetermined force is applied to the tubular member.

12. A packer of the character defined in claim 11, wherein said one sleeve has a shoulder thereon against which the holding ring is lifted so as to move said one sleeve into extended position with respect to said other sleeve upon continued lifting of the tubular member.

13. A packer of the character defined in claim 11, including means on the other sleeve for catching and retrieving the thrust ring.

* * * * *